US006306021B1

(12) United States Patent
Masumura et al.

(10) Patent No.: US 6,306,021 B1
(45) **Date of Patent: *Oct. 23, 2001**

(54) POLISHING PAD, POLISHING METHOD, AND POLISHING MACHINE FOR MIRROR-POLISHING SEMICONDUCTOR WAFERS

(75) Inventors: Hisashi Masumura; Makoto Kobayashi; Teruaki Fukami; Tsutomu Takaku, all of Fukushima-ken; Mamoru Okada, Nagano-ken, all of (JP)

(73) Assignee: Shin-Etsu Handotai Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/237,881

(22) Filed: Jan. 27, 1999

(30) Foreign Application Priority Data

Jan. 29, 1998 (JP) ..... 10-032241
Aug. 27, 1998 (JP) ..... 10-259411

(51) Int. Cl.[7] ..... B24B 5/00; B24B 29/00
(52) U.S. Cl. ..... 451/287; 451/526
(58) Field of Search ..... 451/41, 39, 60, 451/63, 285, 287, 288, 259, 526, 528, 529, 533

(56) References Cited

U.S. PATENT DOCUMENTS

| | | | | |
|---|---|---|---|---|
| 5,212,910 | | 5/1993 | Breivogel et al. . | |
| 5,664,990 | * | 9/1997 | Adams et al. | 451/287 |
| 5,725,417 | * | 3/1998 | Robinson | 451/287 |
| 6,007,407 | * | 12/1999 | Rutherford et al. | 451/552 |

OTHER PUBLICATIONS

Watanabe, et al. "The Structure of a Polishing Pad for Polishing While the Surface is Used as a Reference," Spring Meeting, Japan Society for Precision Engineering, 1997, p. 183–184.

* cited by examiner

*Primary Examiner*—Derris H. Banks
(74) *Attorney, Agent, or Firm*—Hogan & Hartson, L.L.P.

(57) ABSTRACT

There is disclosed a polishing pad for mirror-polishing a semiconductor wafer, especially in a finish polishing process, by use of a polishing machine which includes a turn table on which a polishing pad is attached, a unit for feeding a polishing agent onto a surface of the polishing pad, and a mechanism for pressing a semiconductor wafer onto the surface of the polishing pad. The polishing pad includes a top layer formed of a porous soft material, a bottom layer formed of a rubber elastomer, and an intermediate layer formed of a hard plastic sheet. The hard plastic sheet is disposed between the top layer and the bottom layer and is bonded to the bottom layer. In the polishing pad, undulation produced in the bottom layer due to a horizontal force generated during polishing is prevented from being transferred to the top layer of the polishing pad, and unevenness in polishing stock removal stemming from warpage or undulation of a wafer itself can be mitigated.

14 Claims, 1 Drawing Sheet

POLISHING PAD, POLISHING METHOD, AND POLISHING MACHINE FOR MIRROR-POLISHING SEMICONDUCTOR WAFERS

BACKGROUND OF THE INVENTION

1. Field of the Invention

The present invention relates to a polishing pad for mirror-polishing semiconductor wafers, and to a mirror-polishing method and a mirror-polishing machine which use the polishing pad.

2. Background Art

Conventionally, in a semiconductor-device fabrication process, thin films such as oxide film, metal film, or polycrystal silicon film are layered on a semiconductor wafer in order to form elements thereon. In such a process, when a plurality of wiring layers are formed, the surfaces thereof become uneven, resulting in occurrence of a problem that focusing cannot be performed properly when a fine pattern is exposed and printed on the surface. In order to solve the problem, a so-called CMP (Chemical Mechanical Polishing) technique has been proposed. In relation to the CMP technique, use of a polishing pad having a two-layer structure has been proposed in order to maintain a constant distribution of thickness of films and eliminate fine unevenness on the films (see (Junji Watanabe et al. "The Structure of a Polishing Pad for Polishing while the Surface is Used as a Reference," papers of Spring Meeting, The Japan Society for Precision Engineering, 183 (1997)). In the two-layer polishing pad, the bottom layer is formed of a rubber elastomer in order to remove nonuniformity of polishing stock removal caused by warpage or a large undulation of a wafer itself; and a top layer is formed of hard cloth in order to eliminate unevenness on the wafer surface generated in a semiconductor device fabricating process, to thereby obtain a flat surface.

Meanwhile, in the production of mirror-polished wafers for semiconductor devices, mirror-polishing is performed in order to obtain a desired flatness and surface roughness. In the conventional polishing process, one surface of a semiconductor is rough-polished by use of a hard single-layer polishing pad in order to obtain a desired flatness, and the surface is then finish-polished by use of a single-layer soft polishing pad in order to obtain a desired roughness.

In general, mirror-polishing is performed in a single stage or multiple stages, and a so-called suede-type polishing pad is used in the final or finish polishing. In the suede-type polishing pad, polyurethane is layered on a substrate sheet formed of polyurethane-impregnated polyester felt or the like, a foam layer is grown in the polyurethane, and the surface portion of the foam layer is removed in order to form fluffy openings in the foam layer. When the surface of a semiconductor wafer is removed by an amount of a few to a few hundreds of nano-millimeters through use of such a suede-type polishing pad, surface roughness having a period of a few to a few tens of nano-millimeters (hereinafter may be referred to as "haze") can be improved to a sufficient degree.

By the way, with a recent increase in the degree of integration of semiconductor devices, the requirement for the flatness of wafers has become more strict. Therefore, a conventional polishing method for semiconductor mirror-polished wafers cannot achieve a flatness required for production of state-of-the-art semiconductor devices. Therefore, there has arisen a requirement to maintain a flatness obtained through flatness-improving machining, such as double-side polishing or surface grinding, until completion of final or finish polishing.

Further, since improvement of surface roughness—which is a purpose of finish polishing—can be achieved by finish polishing in which the polishing stock removal has been set to a very small amount as described above, the degradation of flatness due to the finish polishing has been considered ignorable.

In general, the above-described CMP technique is employed in order to achieve uniform polishing stock removal. However, when a two-layer polishing pad having a hard top layer that has conventionally been used in the CMP technique is used, a polished wafer will have a degraded surface roughness. Especially, when such a two-layer polishing pad is used for finish polishing, improvement in the haze level, which is the purpose of the finish polishing, becomes difficult. Further, when a two-layer polishing pad having a top layer formed of a suede-type polishing pad that has conventionally been used for finish polishing is used, undulation is generated in the bottom layer made of rubber elastomer, due to a horizontal force generated during polishing, and the undulation is transferred to the top layer of the polishing pad, resulting in occurrence of a problem that a wafer is polished unevenly in terms of polishing stock removal. Especially, this problem tends to become remarkable in the vicinity of the edge portion of a wafer. Since the top layer is softer than the top layer that has been used in conventional two-layer polishing pads, the top layer exhibits excessively high performance of following undulation of the bottom layer, resulting in degradation in uniformity of polishing stock removal at the peripheral portion of a wafer, which causes a variation in flatness before and after finish polishing.

The inventors of the present invention investigated variations in flatness caused by finish polishing, and found that the flatness can be degraded to a large degree even by finish polishing in which stock removal is very small. Accordingly, the inventors considered that there must be developed a finish polishing method that does not degrade flatness or that can secure uniform polishing stock removal.

SUMMARY OF THE INVENTION

The present invention has been accomplished to solve the above-mentioned problems, and an object of the present invention is to provide a polishing pad for mirror-polishing, in which undulation produced in a bottom layer made of rubber elastomer due to a horizontal force generated during polishing is prevented from being transferred to a top layer of the polishing pad, and which mitigates unevenness in polishing stock removal stemming from warpage or undulation of a wafer itself, as well as a polishing method and a polishing machine which utilize the polishing pad.

Another object of the present invention is to provide a polishing pad for finish mirror-polishing which has the same features as those of the above-described polishing pad for mirror-polishing, as well as a polishing method and a polishing machine for finish polishing which utilize the polishing pad.

In order to achieve the above object, the present invention provides a polishing pad for mirror-polishing a semiconductor wafer by use of a polishing machine comprising a turn table on which a polishing pad is attached, a unit for feeding a polishing agent onto a surface of the polishing pad, and a mechanism for pressing a semiconductor wafer onto the surface of the polishing pad, wherein the polishing pad comprises a top layer formed of a porous soft material, a bottom layer formed of a rubber elastomer, and a hard plastic sheet disposed between the top layer and the bottom layer and bonded to the bottom layer.

Since the polishing pad has a three-layer structure including a top layer formed of a porous soft material, an intermediate layer formed of a hard plastic sheet, and a bottom layer formed of a rubber elastomer, and the hard plastic sheet serving as the intermediate layer has sufficient stiffness, undulation produced in a bottom layer made of rubber elastomer due to a horizontal force generated during polishing is prevented from being transferred to a top layer of the polishing pad. In addition, unevenness in polishing stock removal stemming from warpage or undulation of a wafer itself is mitigated, so that semiconductor wafers having a desired flatness and surface roughness can be produced.

In this case, the tensile strength of the hard plastic sheet is preferably 1 MPa or more; the material of the hard plastic sheet is preferably selected from the group of polyethylene terephthalate (PET), polyimide, polyethylene, and polyurethane; and the thickness of the hard plastic sheet is preferably 0.02 to 0.2 mm.

When the tensile strength of the hard plastic sheet serving as the intermediate layer is less than 1 MPa, a sufficient degree of stiffness cannot be obtained. Therefore, a material having a tensile strength of 1 MPa or more is preferably selected for the intermediate layer.

When the material of the hard plastic sheet is selected from the above-described materials, physical properties required in the present invention are obtained.

When the thickness of the hard plastic sheet is less than 0.02 mm, the stiffness becomes insufficient, so that the plastic sheet cannot absorb undulation generated in the bottom layer and generates resonance. When the thickness of the hard plastic sheet exceeds 0.2 mm, the stiffness becomes excessively high, so that warpage or undulation of the hard plastic sheet itself affects uniformity in polishing stock removal. Therefore, the thickness of the hard plastic sheet is preferably set to fall within the range of 0.02 to 0.2 mm.

Further, the top layer formed of a porous soft material preferably has an Asker C hardness of 80 or less, and the bottom layer formed of a rubber elastomer preferably has an Asker C hardness of 15 to 40.

When the hardnesses of the top layer and the bottom layer are set in the above-described manner, the characteristics of the polishing pad having a three-layer structure can be utilized to a sufficient degree, with the result that a mirror polished wafer having a desired flatness and surface roughness can be obtained. When the Asker C hardness of the top layer exceeds 80, the surface roughness is undesirably degraded. Therefore, the Asker C hardness of the top layer is preferably set to 80 or less. When the Asker C hardness of the bottom layer is less than 15, the bottom layer becomes excessively soft, resulting in generation of large undulation. When the Asker C hardness of the bottom layer exceeds 40, the hardness becomes excessively high, so that warpage or undulation of the bottom layer itself affects uniformity in polishing stock removal. Therefore, the hardness of the bottom layer is preferably set to fall within the range of 15 to 40.

The present invention also provides a multi-layer polishing pad for mirror-polishing the surface of a semiconductor wafer in a finish polishing process by use of a polishing machine comprising a turn table on which a polishing pad is attached, a unit for feeding a polishing agent onto a surface of the polishing pad, and a mechanism for pressing a semiconductor wafer onto the surface of the polishing pad, wherein the multi-layer polishing pad comprises a top layer formed of a suede-type polishing cloth, a bottom layer formed of a rubber elastomer, and a hard plastic sheet disposed between the top layer and the bottom layer and bonded to the bottom layer.

Since the polishing pad has a three-layer structure including a top layer formed of suede-type polishing cloth, an intermediate layer formed of a hard plastic sheet, and a bottom layer formed of a rubber elastomer, and the hard plastic sheet serving as the intermediate layer has sufficient stiffness, undulation produced in a bottom layer made of rubber elastomer due to a horizontal force generated during finish polishing is prevented from being transferred to the top layer of the polishing pad. In addition, unevenness in polishing stock removal stemming from warpage or undulation of a wafer itself is mitigated, so that semiconductor wafers having excellent surfaces of a desired flatness and haze level can be produced.

In this finish polishing, the thickness of the hard plastic sheet is preferably 0.1 to 0.4 mm.

When the thickness of the hard plastic sheet used in the polishing pad for finish polishing is set to fall within the above-described range, the hard plastic sheet has a proper stiffness, so that the plastic sheet can sufficiently absorb the undulation generated in the bottom layer and does not generate resonance. Further, warpage or undulation of the hard plastic sheet itself does not affect uniformity in polishing stock removal.

In this case, the bottom layer formed of a rubber elastomer preferably has an Asker C hardness of 20 to 60.

When the hardness of the bottom layer is set to fall within the above-described range, the bottom layer does not become excessively soft, so that no large undulation is generated. Further, since the bottom layer does not become excessively hard, warpage or undulation of the bottom layer itself does not affect uniformity in polishing stock removal.

Moreover, the thickness of the nap layer of the top layer formed of the above-described suede-type polishing cloth is preferably 400 to 800 $\mu$m.

The nap layer refers to the surface-layer portion of the suede-type polishing cloth, which is formed by the process of growing a foam layer and removing the surface portion of the foam layer in order to form openings in the foam layer.

When the nap layer of the top layer of the polishing pad used for finish polishing has a thickness of the above-described range, the foam diameter at the openings decreases, so that the haze level is improved. Further, the friction resistance between a wafer and the polishing pad decreases, with the result that the degree of undulation of the bottom layer formed of a rubber elastomer decreases. Therefore, the degree of undulation that is transmitted to the top surface via the intermediate layer can be decreased.

The present invention further provides a mirror-polishing method for a semiconductor wafer, wherein a semiconductor wafer is mirror-polished by use of a polishing pad for mirror polishing according to the present invention.

According to the method of the present invention, undulation produced in a bottom layer made of rubber elastomer due to a horizontal force generated during polishing is absorbed by the intermediate layer, with the result that uniformity in polishing stock removal and surface roughness are improved.

The present invention also provides a mirror-polishing method for a semiconductor wafer, wherein a semiconductor wafer is finish-polished by use of a multi-layer polishing pad for finish polishing according to the present invention.

According to the method of the present invention, in the finish polishing, a haze level comparable to that obtained through use of a single-layer polishing pad is obtained without impairment of a high degree of uniformity in polishing stock removal.

Moreover, the present invention provides a mirror-polishing machine for a semiconductor comprising a turn table on which a polishing pad is attached, a unit for feeding a polishing agent onto a surface of the polishing pad, and a mechanism for pressing a semiconductor wafer onto the surface of the polishing pad, wherein the mirror-polishing pad according to the present invention is attached to the turn table.

In the polishing machine in which the polishing pad having a three-layer structure according to the present invention is attached to the turn table, due to the stiffness of the hard plastic sheet serving as the intermediate layer, undulation produced in a bottom layer made of rubber elastomer due to a horizontal force generated during polishing is prevented from being transferred to a top layer of the polishing pad. In addition, unevenness in polishing stock removal stemming from warpage or undulation of a wafer itself is mitigated, so that semiconductor wafers having a desired flatness and surface roughness can be produced. Moreover, since the polishing machine can cope with a recent increase in the degree of integration in a device fabrication process, the productivity and yield of semiconductor devices can be improved considerably.

The present invention also provides a mirror-polishing machine for a semiconductor comprising a turn table on which a polishing pad is attached, a unit for feeding a polishing agent onto a surface of the polishing pad, and a mechanism for pressing a semiconductor wafer onto the surface of the polishing pad, wherein the multi-layer polishing pad for finish polishing according to the present invention is attached to the turn table.

In the polishing machine in which the polishing pad having a three-layer structure according to the present invention is attached to the turn table, due to the stiffness of the hard plastic sheet serving as the intermediate layer, undulation produced in a bottom layer made of rubber elastomer due to a horizontal force generated especially during finish polishing is prevented from being transferred to a top layer of the polishing pad. In addition, unevenness in polishing stock removal stemming from warpage or undulation of a wafer itself is mitigated, so that semiconductor wafers having a desired flatness and haze level can be produced. Moreover, since the polishing machine can cope with a recent increase in the degree of integration in a device fabrication process, the productivity and yield of semiconductor devices can be improved considerably.

As described above, in the present invention, undulation produced in the rubber elastomer serving as the bottom layer of the polishing pad due to a horizontal force generated during mirror polishing is prevented from being transferred to the top layer of the polishing pad. In addition, unevenness in polishing stock removal stemming from warpage or undulation of a wafer itself is mitigated, so that a produced wafer will have a mirror-finished surface having an excellent flatness and improved surface roughness. Therefore, it becomes possible to cope with an increase in the degree of integration in a device fabrication process, while improving the productivity and yield of semiconductor devices. Especially, during final or finish polishing, a desirable haze level is maintained and the uniformity in flatness is improved through polishing in which the stock removal is set to a relatively small amount.

BRIEF DESCRIPTION OF THE DRAWINGS

FIGS. 2A and 2B are explanatory views for comparison between a three-layer polishing pad according to the present invention and a conventional two-layer polishing pad in terms of action and effect, wherein FIG. 2A shows the three-layer polishing pad according to the present invention, and FIG. 2B shows the conventional two-layer polishing pad.

DETAILED DESCRIPTION OF PREFERRED EMBODIMENT

An embodiment of the present invention will now be described; however, the present invention is not limited thereto.

The present inventors found that when semiconductor wafers are mirror-polished by use of a two-layer polishing pad that has been used in the CMP technique, in some cases, a sufficient degree of uniformity in terms of polishing stock removal cannot be obtained and surface roughness does not reach an acceptable level. The inventors investigated the causes of the above problem and found that due to a horizontal force generated during polishing, undulation is generated in rubber elastomer serving as a bottom layer, the undulation becomes large especially in the vicinity of the edge of a wafer, and such a large undulation is transferred to the top layer of the polishing pad.

Through investigations and studies on the material and structure of the polishing pad performed for finding a measure for preventing generation of undulation in the bottom layer of the polishing pad, the present inventors found that the above-described problem can be solved by inserting a hard plastic sheet between the top layer and the bottom layer of the above-described two-layer polishing pad. The present invention was achieved on the basis of this finding and through thorough investigation of other conditions.

First, with reference to the drawings, there will be described a single-side polishing machine in which a polishing pad for mirror-polishing according to the present invention is used.

Figure 1:
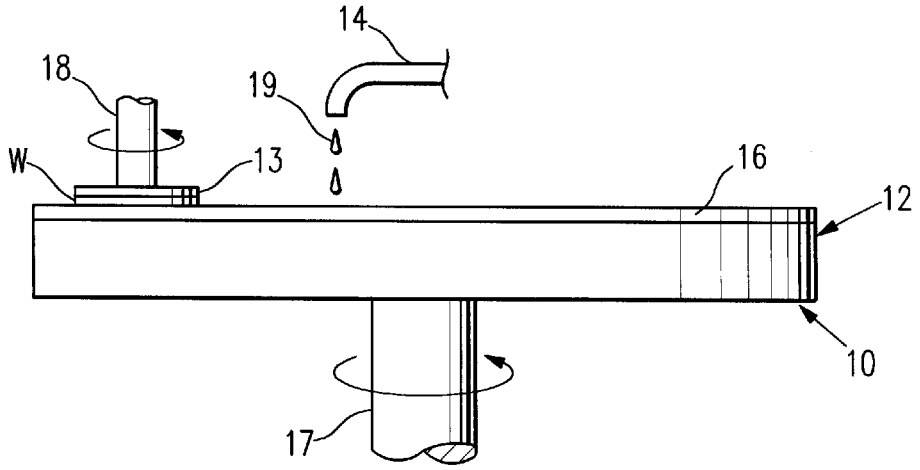
FIG. 1 is a view schematically showing the structure of a single-side polishing machine to which a polishing pad for mirror-polishing according to the present invention is attached.

As shown in FIG. 1, the single-side polishing machine 10 is constructed to polish one side of a semiconductor wafer.

That is, the polishing machine 10 includes a turn table 12, a wafer holder 13, and a polishing agent supply unit 14. A polishing pad 16 is bonded to the top face of the turn table 12. The turn table 12 is rotated at a predetermined rotary speed via a rotary shaft 17.

The wafer holder 13 holds a wafer W at the bottom surface thereof by means of vacuum suction or the like, and is rotated via a rotary shaft 18. The wafer holder 13 presses the wafer W against the polishing pad 16 with a predetermined load. The polishing agent supply unit 14 supplies polishing agent 19 onto the polishing pad 16 at a predetermined flow rate. The polishing agent 19 enters the space between the wafer W and the polishing pad 16, so that the wafer W is polished.

Next, a three-layer polishing pad of the present invention will be described.

The polishing pad according to the present invention is used for mirror-polishing a semiconductor wafer by use of a polishing machine including at least a turn table on which a polishing pad is attached, a unit for feeding a polishing agent onto a surface of the polishing pad, and a mechanism for pressing a semiconductor wafer onto the surface of the polishing pad, and comprises a top layer formed of a porous soft material, a bottom layer formed of a rubber elastomer, and a hard plastic sheet disposed between the top layer and the bottom layer and bonded to the bottom layer.

Since the polishing pad has a three-layer structure including a top layer formed of a porous soft material, an intermediate layer formed of a hard plastic sheet, and a bottom layer formed of a rubber elastomer, due to the stiffness of the hard plastic sheet serving as the intermediate layer, undulation produced in a bottom layer made of rubber elastomer due to a horizontal force generated during polishing is prevented from being transferred to a top layer of the polishing pad. In addition, unevenness in polishing stock removal stemming from warpage or undulation of a wafer itself is mitigated, so that semiconductor wafers having a desired flatness and surface roughness can be produced.

Figure 2A:
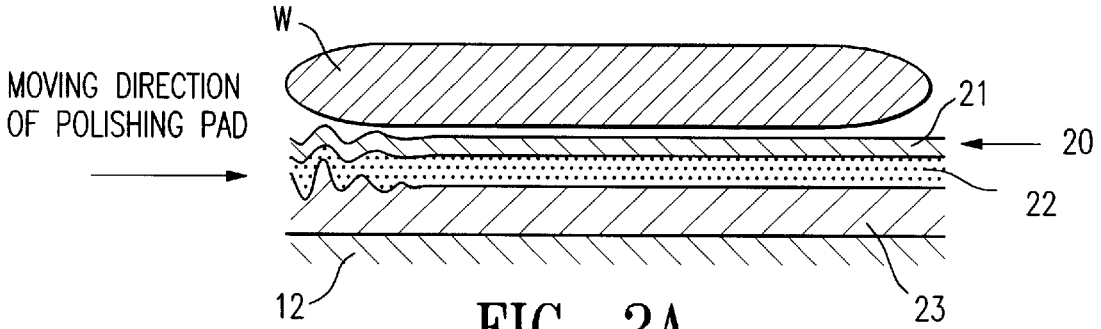
Figure 2B:
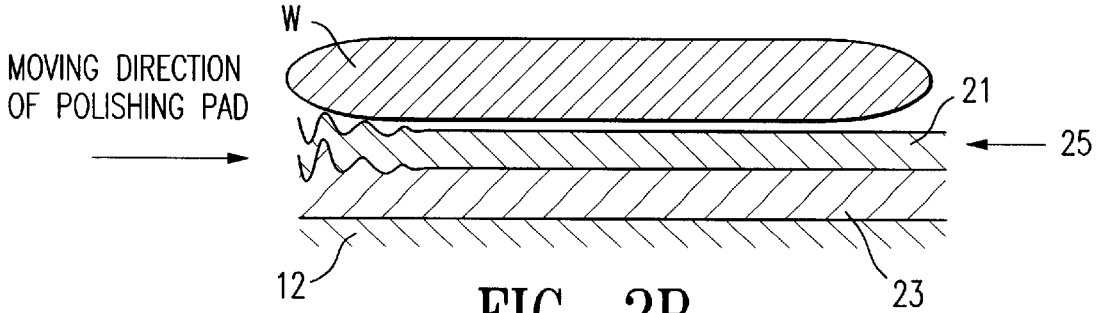

FIGS. 2A and 2B are explanatory views for comparison between a three-layer polishing pad according to the present invention and a conventional two-layer polishing pad, in terms of action and effect.

FIG. 2A shows the case of a three-layer polishing pad 20 according to the present invention; and indicates that due to the rigidity of the hard plastic sheet 22 serving as an intermediate layer, undulation of the bottom layer 23 formed of rubber elastomer is suppressed and is prevented from being transmitted to the top layer 21.

FIG. 2B shows the case of a conventional two-layer polishing pad 25; and indicates that since the polishing pad 25 is formed of a top layer 21 and a bottom layer 23 with no intermediate layer disposed therebetween, undulation is generated in the bottom layer 23 at a position corresponding to the forward end of the wafer W with respect to the direction of relative rotation thereof, and the thus-generated undulation is transmitted to the top layer 21, and that such a phenomenon occurs remarkably at the periphery of the wafer W.

The material of the hard plastic sheet that is used in the present invention and that provides the above-described excellent performance is preferably a plastic that is categorized as a relatively hard plastic such as PET, polyimide, polyethylene, or polyurethane.

The hard plastic sheet preferably has a thickness in the range of 0.02 to 0.2 mm. When the thickness of the hard plastic sheet is less than 0.02 mm, the stiffness becomes insufficient, so that the plastic sheet cannot absorb undulation generated in the bottom layer and generates resonance. When the thickness of the hard plastic sheet exceeds 0.2 mm, the stiffness becomes excessively high, so that warpage or undulation of the hard plastic sheet itself undesirably affects uniformity in polishing stock removal.

The tensile strength of the hard plastic sheet is preferably 1 MPa or more, because a sufficient degree of stiffness cannot be obtained when the tensile strength of the hard plastic sheet is less than 1 MPa.

Examples of the porous soft material used as the top layer of the three-layer polishing pad include velour-type artificial leather formed of urethane-impregnated nonwoven fabric and suede-type artificial leather formed of foamed polyurethane, which are generally used for mirror-polishing of semiconductor wafers. No limitation is imposed on the material of the top layer, except for the surface hardness. The top layer preferably has an Asker C hardness of 80 or less. When the Asker C hardness of the top layer exceeds 80, the surface roughness is undesirably degraded.

Examples of the rubber elastomer used as the bottom layer of the three-layer polishing pad include foamed silicone rubber, foamed urethane rubber, and other sponge-like rubber elastomers. The rubber elastomer preferably has an Asker C hardness of 15 to 40. When the Asker C hardness of the bottom layer is less than 15, the bottom layer becomes excessively soft, resulting in generation of large undulation. When the Asker C hardness of the bottom layer exceeds 40, the hardness becomes excessively high, so that warpage or undulation of the bottom layer itself affects uniformity in polishing stock removal. Therefore, the hardness of the bottom layer is preferably set to fall within the range of 15 to 40.

As described above, when the polishing pad is formed into a three layer structure through use of materials that have physical properties suitable for the respective layers, the properties of a mirror-polishing pad can be brought into full play, so that mirror-polished wafers having a desired flatness and surface roughness can be obtained.

Next, there will be described a three-layer polishing pad suitable for final or finish polishing among various kinds of mirror-polishing processes. The three-layer polishing pad suitable for final or finish polishing improves uniformity in flatness while maintaining a good haze level through polishing involving a small amount of stock removal among the above-described three-layer polishing pads for mirror polishing. The structure of this polishing pad is basically the same as that of the above-described three-layer polishing pad, and a description will be given of only the points that have been improved for finishing polishing.

As the top layer of the polishing pad applied for finish polishing, there is used a so-called suede-type polishing pad which is formed by a method in which polyurethane is layered on a substrate sheet formed of polyurethane-impregnated polyester felt; a foam layer is grown in the polyurethane; and the surface portion of the foam layer is removed in order to form openings in the foam layer.

The suede-type top layer preferably has an Asker C hardness of 80 or less. In this case, since the surface roughness having a longer period becomes better than the level of haze having a shorter period, great change in flatness is prevented.

Further, the nap layer serving as an opening portion preferably has a thickness of 400 to 800 $\mu$m. When the nap layer has a thickness of the above-described range, the foam diameter decreases, so that the haze level is improved. Further, the friction resistance between a wafer and the polishing pad decreases, with the result that the degree of undulation of the bottom layer formed of a rubber elastomer decreases. Therefore, the degree of undulation that is transmitted to the top surface via the intermediate layer can be decreased.

The action and effect of the hard plastic sheet serving as the intermediate layer are the same as the action and effect of the hard plastic sheet used in the above-described three-layer polishing pad for mirror polishing. The material of the hard plastic sheet according to the present invention that provides the above-described excellent performance is preferably a plastic that is categorized as a relatively hard plastic such as PET, polyimide, polyethylene, or polyurethane.

The hard plastic sheet preferably has a thickness in the range of 0.1 to 0.4 mm. In the finish polishing, the hard plastic sheet has a proper stiffness when the thickness of the hard plastic sheet is set to the above-described range, so that the plastic sheet sufficiently absorbs undulation generated in the bottom layer formed of a rubber elastomer and does not generate resonance. Further, warpage or undulation of the hard plastic sheet itself does not affect uniformity in polishing stock removal in the final polishing.

The tensile strength of the hard plastic sheet is preferably 1 MPa or more, in order to secure a sufficient degree of stiffness.

Examples of the rubber elastomer used as the bottom layer of the three-layer polishing pad include foamed silicone rubber, foamed urethane rubber, and other sponge-like rubber elastomers. The rubber elastomer preferably has an Asker C hardness of 20 to 60. When the hardness of the bottom layer is set to fall within the above-described range, the bottom layer does not become excessively soft, so that no large undulation is generated. Further, since the bottom layer does not become excessively hard, warpage or undulation of the bottom layer itself does not affect uniformity in polishing stock removal.

As described above, when the polishing pad is formed into a three layer structure through use of materials that have physical properties suitable for the respective layers, the properties of a finish-polishing pad can be brought into full play, so that mirror-polished wafers having a desired flatness and haze level can be obtained. The reason why the physical properties of the polishing pad are slightly changed for finish polishing is that stock removal is set to a small amount in the finish polishing, and polishing conditions, such as polishing pressure and roughness of abrasive grains, in the finish polishing differ from those of other polishing processes.

EXAMPLES

The present invention will next be described in detail by way of examples; however, the invention is not limited only to these examples.

Asker C hardness indicating the hardness of the top layer and bottom layer will first be explained.

Asker C hardness is measured in accordance with JIS K 6301 and by use of a C-type spring hardness tester, in which a needle is protruded by a spring force through a center hole formed in a pressing surface. The pressing surface of the tester is brought into contact with a surface of a sample rubber, and a distance which the pressing needle is pushed back by the rubber surface is measured as a hardness. The C-type tester vertically presses the samples under a load of 5000 g.

Example 1

(1) Three-layer Polishing Pad:

top layer: SUBA400 (trade name, by Rodel Nitta K.K., a velour type polishing pad made of nonwoven fabric impregnated with urethane resin. Asker C hardness: 76);

bottom layer: SE-200 (trade name, by Sun Polymer K.K., foamed silicone rubber sheet, Asker C hardness: 16);

intermediate layer: PET sheet (thickness: 50 $\mu$m)

(2) Polishing Agent: Colloidal Silica (particle size: a few nm, silica concentration: 2.5 wt. %, pH: 10.5)

(3) Polishing Conditions: Single-side Polishing, load: 300 g/cm$^2$, Relative Polishing Speed: 50 m/min, Polishing Time: 13 minutes)

(4) Sample to be Polished: Silicon Single-crystal Wafer (thickness: 735 $\mu$m)

Mirror-polishing was performed under the above-mentioned conditions (1) to (4), and thickness distribution over the entire surface of the wafer before and after polishing was measured by use of a capacitance type thickness meter. Uniformity of the polishing stock removal was calculated by dividing the difference between the maximum stock removal and the minimum stock removal in the wafer plane (namely the maximum variation in stock removal) by the average stock removal. The average stock removal was 11 $\mu$m and the uniformity in stock removal was 2.6%. Further, the surface micro roughness of the polished wafer was measured by use of an optical interferometric surface roughness meter to obtain an Rrms (root mean square roughness) of 0.25 nm. In this regard, the target Rrms was 0.35 nm.

Example 2

(1) Three-layer Polishing Pad:

top layer: SUBA400 (as described above, Asker C hardness: 76);

bottom layer: SE-200 (as described above, Asker C hardness: 20, 25, 43 (3 levels));

intermediate layer: PET sheet (thickness: 50 $\mu$m)

(2) Polishing Agent: Colloidal Silica (as described above)

(3) Polishing Conditions: Single-side Polishing, Load: 300 g/cm$^2$, Relative Polishing Speed: 50 m/min, Polishing Stock Removal: 10 $\mu$m (4) Sample to be Polished: Silicon Single-crystal Wafer (thickness: 735 $\mu$m)

Mirror-polishing was performed under the above-mentioned conditions (1) to (4), and the uniformity of polishing stock removal was measured to obtain the following results:

| Asker C hardness of bottom layer | Uniformity of stock removal by polishing (%) |
|---|---|
| 20 | 2.3 |
| 25 | 1.8 |
| 43 | 8.2 |
| 16* | 2.6* |

*Example 1

As is apparant from the above results, a uniformity in stock removal of not greater than 5% is obtained when the hardness C of the rubber elastomer serving as the bottom layer is within the range of layer of 15 to 40.

Example 3

(1) Three-layer Polishing Pad:

top layer: SUB400 (as described above, Asker C hardness: 76);

bottom layer: SE-200 (as described above, Asker C hardness: 16);

intermediate layer: polyimide sheet (thickness: 0.0125, 0.05, 0.1, 0.3 mm (4 levels))

(2) Polishing Agent: Colloidal Silica (as described above)

(3) Polishing Conditions: Single-side Polishing, Load: 300 g/cm$^2$, Relative Polishing Speed: 50 m/min, Polishing Stock Removal: 10 $\mu$m (4) Sample to be Polished: Silicon Single-crystal Wafer (thickness: 735 $\mu$m)

Mirror-polishing was performed under the above-mentioned conditions (1) to (4), and the uniformity of polishing stock removal was measured to obtain the following results:

| Thickness of intermediate layer | Uniformity of stock removal by polishing (%) |
|---|---|
| 0.0125 | 5.8 |
| 0.05 | 2.4 |
| 0.1 | 3.6 |
| 0.3 | 7.6 |

As is apparent from the above results, when the hard plastic sheet serving as the intermediate layer is excessively thin, the function as the intermediate layer is lost, resulting in poor uniformity in stock removal. When the hard plastic sheet serving as the intermediate layer is excessively thick, the function of the rubber elastomer serving as the bottom layer is lost, resulting in poor uniformity in stock removal. Therefore, excellent uniformity in stock removal is obtained when the thickness of the intermediate layer falls in the range of 0.02 to 0.2 mm.

Example 4

(1) Three-layer Polishing Pad:

top layer: SUBA400 (as described above, Asker C hardness: 76);

bottom layer: SE-200 (as described above, Asker C hardness: 16);

intermediate layer: the following four sheets:

polyurethane B (thickness: 0.1 mm, tensile strength: 2.5 MPa)

polyurethane A (thickness: 0.1 mm, tensile strength: 0.5 Mpa, product of low degree of polymerization)

polyimide (thickness: 0.1 mm, tensile strength: 82 MPa)

PET (thickness: 0.1 mm, tensile strength: 135 MPa)

(2) Polishing Agent: Colloidal Silica (as described above)

(3) Polishing Conditions: Single-side Polishing, Load: 300 g/cm$^2$, Relative Polishing Speed: 50 m/min, Polishing Stock Removal: 10 $\mu$m (4) Sample to be Polished: Silicon Single-crystal Wafer (thickness: 735 $\mu$m)

Mirror-polishing was performed under the above-mentioned conditions (1) to (4), and the uniformity of polishing stock removal was measured to obtain the following results:

| Intermediate layer | | | Uniformity of |
|---|---|---|---|
| Material | Thickness (mm) | Tensile strength (MPa) | stock removal by polishing (%) |
| polyurethane A | 0.1 | 0.5 | 6.5 |
| polyurethane B | 0.1 | 2.5 | 4.5 |
| polyimide | 0.1 | 82 | 3.6 |
| PET | 0.1 | 135 | 3.2 |

As is apparent from the above results, when the hard plastic sheet serving as the intermediate layer has a tensile strength of 1 MPa or higher, excellent uniformity in stock removal of 5% or less is obtained.

Example 5

(1) Three-layer Polishing Pad:

top layer: SUBA400 (Asker C hardness: 76), SUBA600 (Asker C hardness: 85);

bottom layer: SE-200 (as described above, Asker C hardness: 16);

intermediate layer: PET sheet (thickness: 50 $\mu$m)

(2) Polishing Agent: the Same as in Example 1

(3) Polishing Conditions: the Same as in Example 1

(4) Sample to be Polished: the Same as in Example 1

Mirror-polishing was performed at the average polishing stock removal of 9.2 $\mu$m, and the uniformity in stock removal was measured to obtain the following results:

| Asker C hardness of the top layer | Uniformity of stock removal by polishing (%) |
|---|---|
| 76 | 2.6 |
| 85 | 5.5 |

As is apparent from the above results, when the top layer has an Asker C hardness of 80 or less, excellent uniformity in stock removal of 5% or less is obtained.

Comparative Example 1

(1) Single-layer Polishing Pad: Only SUBA 400 (as described above, Asker C hardness: 76);

(2) Polishing Agent: the Same as Example 1

(3) Polishing Condition: the Same as Example 1

(4) Sample to be Polished: the Same as Example 1

Mirror-polishing was performed at the average polishing stock removal of 5.2 $\mu$m. The uniformity in stock removal of the polished wafer was 32.2%.

Comparative Example 2

(1) Two-layer Polishing Pad: Two-layer Polishing Pad Composed of a top layer and a bottom layer and obtained through omission of the hard plastic sheet serving as the intermediate layer from the three-layer polishing pad of Example 1.

(2) Polishing Agent: the Same as Example 1

(3) Polishing Condition: the Same as Example 1

(4) Sample to be Polished: the Same as Example 1

Mirror-polishing was performed at the average polishing stock removal of 11 $\mu$m. The uniformity in stock removal of the polished wafer was 6.5%.

As is apparent from the above Comparative examples, uniformity in stock removal degrades remarkably when mirror-polishing is performed through use of a single-layer polishing pad including only a top layer formed of a porous soft material or through use of a two-layer polishing pad obtained through omission of the hard plastic sheet serving as the intermediate layer from the three-layer polishing pad of the present invention.

Example 6

(1) Three-layer Polishing Pad:

top layer: CIEGAL 7355 (trade name, by Daiich Lace K.K., suede-type polishing pad, Asker C hardness: 73); bottom layer: HN-400 (trade name, by Tigers Polymer K.K., foamed nitrile rubber sheet, Asker C hardness: 43); intermediate layer: PET sheet (thickness: 300 $\mu$m)

(2) Polishing Agent: Colloidal Silica (particle size: a few nm, silica concentration: 0.5 wt. %, pH: 9.5)

(3) Polishing Condition: Single-side Polishing, Load: 200 g/cm$^2$, Relative Polishing Speed: 50 m/min, Polishing Time: 6 minutes)

(4) Sample to be Polished: Silicon Single-crystal Wafer (thickness: 735 $\mu$m)

Mirror-polishing was performed under the above-mentioned conditions (1) to (4), and GBIR (Grobal Backside Ideal Range) as indices for evaluation of flatness before and after polishing was compared.

GBIR is an index for evaluating thickness variation in the wafer plane and standardized by SEMI (Semiconductor Equipment and Materials Institute) standard M1 etc. The evaluation was performed by use of a capacitance type thickness meter. A measurement error was about ±0.05 $\mu$m. Mirror-polishing was performed at the average polishing stock removal of 0.6 $\mu$m. The amount of change in GBIR was 0.03 $\mu$m.

A haze level of polished wafer was measured by use of a light scattering surface roughness meter. A measured haze level was 37 bit. In this regard, the target of the level was 40 bit. The smaller the bit value is, the better the haze level is.

Example 7

(1) Three-layer Polishing Pad:
top layer: CIEGAL 7355 (as described above, Asker C hardness: 73);
bottom layer: HN-400 (as described above, Asker C hardness: 15, 25, 65 (3 levels));
intermediate layer: PET sheet (thickness: 300 μm)
(2) Polishing Agent: Colloidal Silica (as described above)
(3) Polishing Condition: Single-side Polishing, Load: 200 g/cm$^2$, Relative Polishing Speed: 50 m/min, Polishing Time: 6 Minutes, Polishing Stock Removal: 0.6 μm
(4) Sample to be Polished: Silicon Single-crystal Wafer (thickness: 735 μm)

Finish-polishing was performed under the above-mentioned conditions (1) to (4), and the amount of change in GBIR was measured to obtain the following results.

| Asker C hardness of the bottom layer | Amount of change in GBIR (μm) |
|---|---|
| 15 | 0.13 |
| 25 | 0.02 |
| 65 | 0.16 |
| 43* | 0.03* |

*Example 6

As is apparent from the above results, the amount of change in GBIR can be suppressed within the range of the measurement error, when the rubber elastomer serving as the bottom layer has an Asker C hardness in the range of 20 to 60.

Example 8

(1) Three-layer Finish-polishing Pad:
top layer: CIEGAL 7355 (as described above, Asker C hardness: 73);
bottom layer: HN-400 (as described above, Asker C hardness: 43);
intermediate layer: PET sheet (thickness: 0.05, 0.1, 0.3, 0.5 mm (4 levels)
(2) Polishing Agent: Colloidal Silica (as described above)
(3) Polishing Condition: Single-side Polishing, Load: 200 g/cm$^2$; Relative Polishing Speed: 50 m/min, Polishing Time: 6 Minutes, Polishing Stock Removal: 0.6 μm
(4) Sample to be Polished: Silicon Single-crystal Wafer (thickness: 735 μm)

Finish-polishing was performed under the above-mentioned conditions (1) to (4), and the amount of change in GBIR was measured to obtain the following results.

| Thickness of the intermediate layer (mm) | Amount of change in GBIR (μm) |
|---|---|
| 0.05 | 0.14 |
| 0.1 | 0.04 |
| 0.3 | 0.03 |
| 0.5 | 0.10 |

As is apparent from the above results, the amount of change in GBIR can be suppressed within the range of the measurement error when the hard plastic sheet serving as the intermediate layer has a thickness in the range of 0.1 to 0.4 mm.

Example 9

(1) Three-layer Finish-polishing Pad:
top layer: CIEGAL 7355 (as described above, Asker C hardness: 73);
bottom layer: HN-400 (as described above, Asker C hardness: 43);
intermediate layer: the following four sheets:
polyurethane A (thickness: 0.3 mm, tensile strength: 0.5 MPa)
polyurethane B (thickness: 0.3 mm, tensile strength: 2.5 MPa)
polyimide (thickness: 0.3 mm, tensile strength: 82 MPa)
PET (thickness: 0.3 mm, tensile strength: 135 MPa)
(2) Polishing Agent: Colloidal Silica (as described above)
(3) Polishing Condition: Single-side Polishing, Load: 200 g/cm$^2$, Relative Polishing Speed: 50 m/min, Polishing Time: 6 Minutes, Polishing Stock Removal: 0.6 μm
(4) Sample to be Polished: Silicon Single-crystal Wafer (thickness: 735 μm)

Finish-polishing was performed under the above-mentioned conditions (1) to (4), and the amount of change in GBIR was measured to obtain the following results:

| Material | Intermediate layer Thickness (mm) | Tensile strength (MPa) | Amount of change in GBIR (μm) |
|---|---|---|---|
| polyurethane A | 0.3 | 0.5 | 0.15 |
| polyurethane B | 0.3 | 2.5 | 0.04 |
| polyimide | 0.3 | 82 | 0.03 |
| PET | 0.3 | 135 | 0.03 |

As is apparent from the above results, the amount of change in GBIR can be suppressed within the range of the measurement error, when the hard-plastic-sheet intermediate layer has a tensile strength of 1 MPa or more.

Example 10

(1) Three-layer Finish-polishing Pad:
top layer: two kinds of suede type polishing pads having different Asker C hardnesses that were produced by impregnating urethane into felt by use of different methods.
(Asker C hardness: 73, 85);
bottom layer: HN-400 (as described above, Asker C hardness: 43);
intermediate layer: PET sheet (thickness: 300 μm)
(2) Polishing Agent: the Same as Example 7
(3) Polishing Condition: the Same as Example 7
(4) Sample to be Polished: the Same as Example 7

Finish-polishing was performed under the above-mentioned conditions (1) to (4), and the amount of change in GBIR was measured to obtain the following results:

| Asker C hardness of the top layer | Amount of change in GBIR (μm) |
|---|---|
| 73 | 0.03 |
| 85 | 0.12 |

As is apparent from the above results, the amount of change in GBIR can be suppressed within the range of the measurement error, when the top layer has an Asker C hardness of 80 or less.

Example 11

(1) Three-layer Finish-polishing Pad:

top layer: four kinds of polishing pads having different nap layer thickness (Asker C hardness: 73, nap layer thickness: 350, 500, 700, 900 μm);

bottom layer: HN-400 (as described above, Asker C hardness: 43);

intermediate layer: PET sheet (thickness: 300 μm)

(2) Polishing Agent: the Same as Example 7

(3) Polishing Condition: the Same as Example 7

(4) Sample to be Polished: the Same as Example 7

Finish-polishing was performed under the above-mentioned conditions (1) to (4), and the amount of change in GBIR and the haze level were measured to obtain the following results:

| Nap layer thickness (μm) | Haze level (Bit) | Amount of change in GBIR (μm) |
|---|---|---|
| 350 | 48 | 0.02 |
| 500 | 38 | 0.03 |
| 700 | 38 | 0.02 |
| 900 | 36 | 0.12 |

As is apparent from the above results, the amount of change in GBIR can be suppressed within the range of the measurement error without making the haze level worse when the top layer has a nap layer thickness within the range of 400 to 800 μm.

Comparative Example 3

(1) Single-layer Finish-polishing Pad: CIEGAL (as described above, Asker C hardness: 73);

(2) Polishing Agent: the Same as Example 1

(3) Polishing Condition: the Same as Example 1

(4) Sample to be Polished: the Same as Example 1

Finish-polishing was performed at the average polishing stock removal of 0.6 μm to obtain the following results:

| Structure of Polishing pad | Haze level (Bit) | Amount of change in GBIR (μm) |
|---|---|---|
| Single-layer finish-polishing pad | 38 | 0.51 |
| Three-layer finish-polishing pad | 38 | 0.03 |

Comparative Example 4

(1) Two-layer Finish-polishing Pad: Two-layer Polishing Pad Composed of a Top Layer and a Bottom Layer and Obtained Through Removal of the Hard Plastic Sheet Serving as the Intermediate Layer from the Three-layer Polishing Pad of Example 6.

(2) Polishing Agent: the Same as Example 6

(3) Polishing Condition: the Same as Example 6

(4) Sample to be Polished: the Same as Example 6

Finish-polishing was performed at the average polishing stock removal of 0.6 μm to obtain the following results:

| Structure of Polishing pad | Haze level (Bit) | Amount of change in GBIR (μm) |
|---|---|---|
| Single-layer finish-polishing pad | 38 | 0.18 |
| Three-layer finish-polishing pad | 38 | 0.03 |

As is apparent from the above Comparative examples, uniformity of polishing stock removal degrades considerably, when finish-polishing is performed through use of a single-layer polishing pad having only a top layer formed of suede-type finish-polishing pad or through use of a two-layer finish-polishing pad obtained through removal of the intermediate layer from the three-layer polishing pad of the present invention.

The present invention is not limited to the above-described embodiments. The above-described embodiments are mere examples, and those having the substantially same structure as that described in the appended claims and providing the similar action and effects are included in the scope of the present invention.

In the above-described embodiments of the present invention, descriptions are given with reference to single-side polishing. However, needless to say, the invention can be applied to double-side polishing.

What is claimed is:

1. A polishing pad for mirror-polishing a semiconductor wafer by use of a polishing machine comprising a turn table on which a polishing pad is attached, a unit for feeding a polishing agent onto a surface of the polishing pad, and a mechanism for pressing a semiconductor wafer onto the surface of the polishing pad, wherein the polishing pad comprises:

a top layer formed of a porous soft material;

a bottom layer formed of a rubber elastomer; and a hard plastic sheet which is un-segmented and which is disposed between the top layer and the bottom layer and bonded to the bottom layer.

2. A polishing pad for mirror-polishing a semiconductor wafer according to claim 1, wherein the tensile strength of the hard plastic sheet is 1 MPa or more.

3. A polishing pad for mirror-polishing a semiconductor wafer according to claim 2, wherein the material of the hard plastic sheet is selected from the group of polyethylene terephthalate, polyimide, polyethylene, and polyurethane.

4. A polishing pad for mirror-polishing a semiconductor wafer according to claim 3, wherein the thickness of the hard plastic sheet is 0.02 to 0.2 mm.

5. A polishing pad for mirror-polishing a semiconductor wafer according to claim 2, wherein the thickness of the hard plastic sheet is 0.02 to 0.2 mm.

6. A polishing pad for mirror-polishing a semiconductor wafer according to claim 1, wherein the material of the hard plastic sheet is selected from the group of polyethylene terephthalate, polyimide, polyethylene, and polyurethane.

7. A polishing pad for mirror-polishing a semiconductor wafer according to claim 6, wherein the thickness of the hard plastic sheet is 0.02 to 0.2 mm.

8. A polishing pad for mirror-polishing a semiconductor wafer according to claim 1, wherein the thickness of the hard plastic sheet is 0.02 to 0.2 mm.

9. A polishing pad for mirror-polishing a semiconductor wafer according to claim 1, wherein the top layer formed of a porous soft material has an Asker C hardness of 80 or less.

10. A polishing pad for mirror-polishing a semiconductor wafer according to claim 1, wherein the bottom layer formed of a rubber elastomer has an Asker C hardness of 15 to 40.

11. A polishing pad for mirror-polishing a semiconductor wafer in a finish polishing process by use of a polishing machine comprising a turn table on which a polishing pad is attached, a unit for feeding a polishing agent onto a surface of the polishing pad, and a mechanism for pressing a semiconductor wafer onto the surface of the polishing pad, wherein the polishing pad comprises:

a top layer formed of a suede-type polishing cloth;

a bottom layer formed of a rubber elastomer; and a hard plastic sheet which is un-segmented and which is disposed between the top layer and the bottom layer and bonded to the bottom layer.

12. A polishing pad for mirror-polishing a semiconductor wafer according to claim 11, wherein the thickness of the hard plastic sheet is 0.1 to 0.4 mm.

13. A polishing pad for mirror-polishing a semiconductor wafer according to claim 11, wherein the bottom layer formed of a rubber elastomer has an Asker C hardness of 20 to 60.

14. A polishing pad for mirror-polishing a semiconductor wafer according to claim 11, wherein the thickness of the nap layer of the top layer formed of a suede-type polishing cloth is 400 to 800 $\mu$m.

* * * * *